United States Patent [19]

Paolillo

[11] Patent Number: 4,875,682

[45] Date of Patent: Oct. 24, 1989

[54] PRACTICE PUTTING GAME

[76] Inventor: Michael Paolillo, 80 Parkview Dr., Searingtown, N.Y. 11040

[21] Appl. No.: 267,392

[22] Filed: Nov. 4, 1988

[51] Int. Cl.[4] ..... A63B 67/02; A63B 69/36

[52] U.S. Cl. ..... 273/176 F; 273/180; 273/185 R; 206/315.9

[58] Field of Search ..... 273/176 F, 184 R, 184 A, 273/185 R, 176 FA, 176 FB, 176 B, 176 E, 176 F, 180

[56] References Cited

U.S. PATENT DOCUMENTS

| | | | |
|---|---|---|---|
| 1,961,060 | 5/1934 | McCarthy | 273/184 A |
| 3,038,726 | 6/1962 | Hesidence | 273/176 F |
| 3,310,313 | 3/1967 | Colson | 273/180 |
| 3,434,720 | 3/1969 | Hall | 273/180 |
| 3,467,704 | 9/1969 | Nelson | 273/180 X |
| 4,336,939 | 6/1982 | Krumlauf | 273/176 FB |

FOREIGN PATENT DOCUMENTS

| | | | |
|---|---|---|---|
| 221168 | 9/1924 | United Kingdom | 273/176 FB |
| 358362 | 10/1931 | United Kingdom | 273/176 F |

*Primary Examiner*—George J. Marlo

*Attorney, Agent, or Firm*—Collard, Roe & Galgano

[57] ABSTRACT

A practice putting game having a rigid base of predetermined width and length has a top putting surface. The rigid base has a bottom surface for contact with a support surface, such as a floor, and has first and second ends having the predetermined width. A receptable is placed adjacent each of the first and second ends of the rigid base with each receptable having at least three compartments. The three compartments are open towards the respective first and second ends of the rigid base. The floor surface of each receptacle is flush with the top putting surface of the rigid base. Each receptacle is sized so that is can hold at least 20 golf balls and has a surface which is rearwardly inclined so that the balls remain within the receptable while the putting game is in use.

12 Claims, 2 Drawing Sheets

PRACTICE PUTTING GAME

BACKGROUND OF INVENTION

1. Field of the Invention

The present invention pertains to a golf practice game and training aid. More particularly, the invention relates to a apparatus which, while improving the golfer's putting skill, allows for the capture of a relatively large number of golf balls at either end thereof so that the majority of time spent by the golfer with the apparatus is in putting rather than walking back and forth.

2. Description of the Prior Art

Various prior art patents disclose training aids for use in the improvement of a golfer's putting game. Such devices may consist of a metallic ring designed to be placed, face up, on a floor or carpet surface. The golfer places a golf ball at a fixed distance away, and using a golf putter, attempts to stroke the ball into the ring. To obtain a non-skid surface on which the ball will roll uniformly, it is necessary to locate the metal ring on a carpet surface. However, not all carpet surfaces have the same general characteristics (i.e., resiliency, uniform surface height, resistance to movement), as the green of a golf course. Furthermore, the surface characteristics of a rug or carpet will vary depending on the fiber, nap, age of the surface, and wear etc. Since the metal ring can be placed at different locations, it is not always possible to insure that the same surface conditions will be encountered from one location to another.

In order to overcome the disadvantages of the metal ring type of golf ball receptable various training aids havebeen prepared. The aid shown in U.S. Pat. No. 4,294,450 which issued to J. Gallic discloses a golf putting green in which a flexible base layer of predetermined length and a predetermined surface characteristic is provided. U.S. Pat. No. 3,601,407 to A. Lorrance discloses a putting device in which the elevation contour of the putting surface can be varied.

U.S. Pat. No. 2,539,046 which issued to D. P. Wright discloses an indoor golf game having a centrally located cup with a tubular extension to carry the cupped balls to a peripheral channel. U.S. Pat. No. 2,606,028 which issued to I. Zion discloses a golf practice device with an undulating terrain. U.S. Design Pat. Nos. 83,500 and 235,112 also disclose various golf putting devices.

It has been found that these prior art golf putting games have a limited capacity for receiving golf balls and require that the balls be retrieved and returned to a putting end of the game prior to again initiating putting practice. There has been a need for a golf practice putting game in which a relatively large number of balls can be putted in a first direction towards a receptacle with a plurality of compartments requiring different positions of the golf putter head and which can be used from either end of the practice game. Thus, putting may take place from either end by one golfer or from each end by two golfers utilizing the same practice putting game. It has been found especially beneficial to use the device of the present invention with two golfers who putt a relatively large number of balls, at least 20, back and forth to one another.

SUMMARY OF THE INVENTION

It is an object of the invention to provide an improved golf putting practice game and training aid.

It is a further object of the invention to provide a golf training aid having a true putting surface and having receptacles at both ends for receiving a relatively large number of golf balls putted in each direction.

It is still a further object of the invention to provide a golf practice putting game which is simple in design and economical to manufacture and which can be disassembled for easy storage.

Accordingly, these and related objects are achieved by a practice putting game made up of a rigid base of predetermined width and length having a top putting surface and bottom surface for contact with a floor. The rigid base has first and second ends having a receptable adjacent thereto having a width generally equal to that of the rigid base. Each receptable has at least three compartments, each being open towards the respective first and second ends of the rigid base and each capable of receiving a plurality of golf balls. The bottom surface of the rigid base may include the hooked portion of a hook and loop type fastener such as a VELCRO type fastener so that the rigid base may be securely attached to a floor having a rug thereon.

This device also embraces the concept of hearing the ball go into the compartment, which represents the hole on a putting green. Hearing the ball enter the compartment will overcome the tendency to look up to follow the path of the ball while putting, thus markedly improving the accuracy of the putting stroke.

Normally the rigid base would be covered by a fabric simulating the putting surface, which fabric may be bonded to the top surface of the rigid base to form the putting surface. It is anticipated that the top putting surface would be flush with the top surfaces of the receptacles although such is not absolutely essential. The receptacles at either end of the putting surface are composed of at least three compartments with a narrow center compartment and two wider outer compartments separated from the center compartment by partitions. Each of the partitions has an end facing toward the rigid base, wherein each of the ends of the partitions is tapered towards the narrower center section.

Each receptacle has a front and rear edge connected by a top surface which is flush with the putting surface of the rigid base but is inclined downwardly toward the rear edge thereof, thus providing a receptacle which prevents balls from moving outwardly back onto the putting surface after being captured within the receptacle. Each receptacle may also be equipped with a signaling device which indicates when a golf ball is successfully putted into the narrower center compartment.

The most suitable material for the rigid base is a sheet of polystyrene foam sold under the brand name STYROFOAM approximately three quarters to one inch thick. This base provides a rigid putting surface but is extremely light, thus making the assembly, disassembly and storage of the putting game simple. In general, the rigid base may be made of two four foot long sections of STYROFOAM, each having the hooked portion of a VELCRO fastener at each edge so that the putting game may be set up on a floor surface having a rug. It is contemplated that the two receptacles are separate elements initially separated from the rigid base and may then be positioned at the outer edge of each of the four foot sections after they have been placed on the rug adjacent to one another in an end-to-end relationship (thus forming an eight foot long putting surface).

These and other objects and advantages of the present invention will become apparent from the following description of the accompanying drawings which disclose two embodiments of the present invention. It is to be understood that the drawings are to be used for the purpose of illustration only, and not as a definition of the invention.

BRIEF DESCRIPTION OF THE DRAWINGS

In the drawings, where similar reference characters denote similar elements throughout the several views.

DESCRIPTION OF PREFERRED EMBODIMENT

Figure 1:
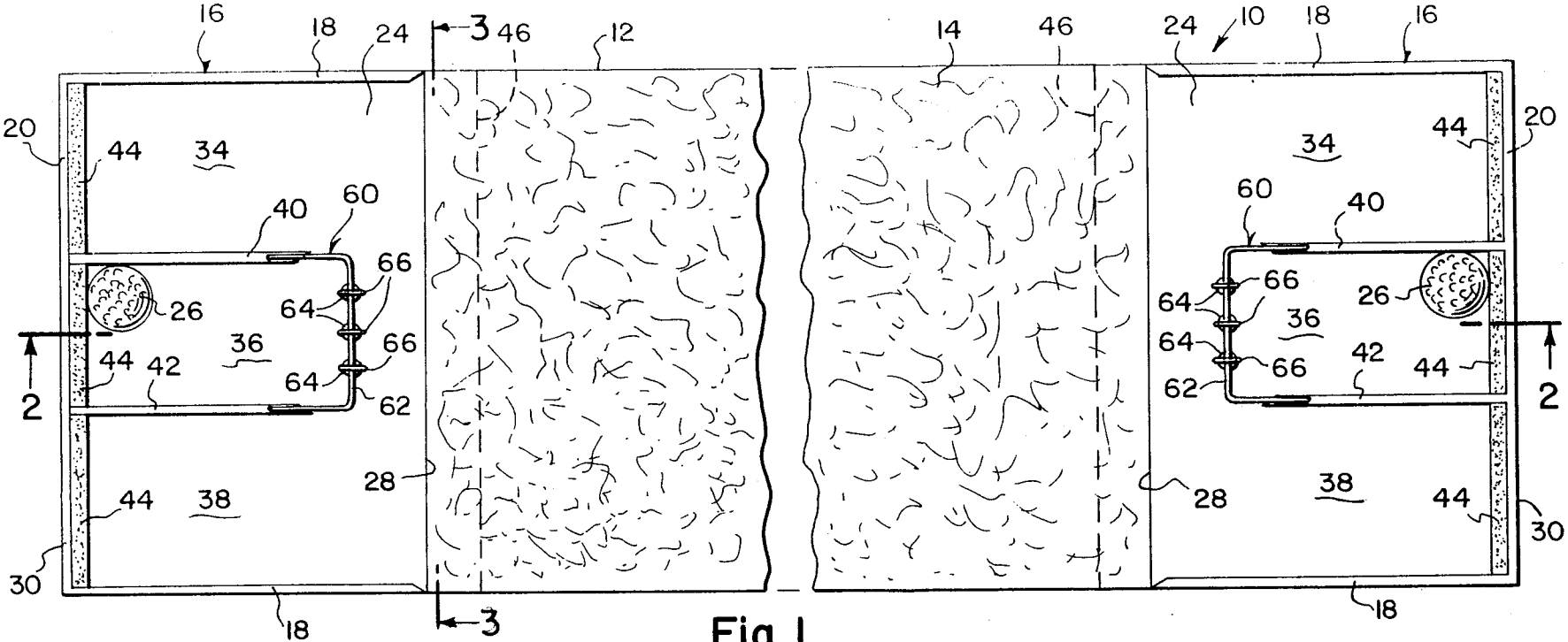
FIG. 1 is a plan view of the practice putting game of the present invention.
Figure 2:
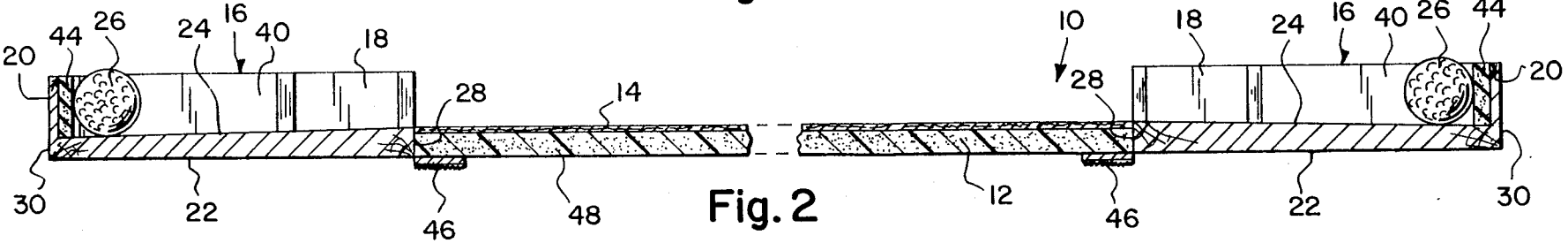
FIG. 2 is a cross-sectional view along line 2—2 of FIG. 1.

Referring now to FIGS. 1 and 2, there is shown a practice putting game generally denoted as 10 having a rigid base 12 preferably made of STYROFOAM or other relatively light material. Rigid base 12 is covered by fabric covering 14 to thereby simulate a golf putting surface. Fabric covering 14 may be any suitable outdoor carpet and it has been found particularly good to place the jute side of the carpet up (i.e., bond the fibers to base 12). In general, rigid base 12 is between ¾ to 1 inch thick, which thickness provides sufficient rigidity and is still extremely light. At either end of rigid base 12 are receptacles 16 having vertically upwardly extending outer side walls 18 and a rear edge wall 20. Each receptacle 16 has a bottom surface 22 and a top surface 24 on which golf balls 26 are collected.

Each receptable 16 has a front edge 28 and a rear edge 30, defined by rear edge wall 20, spaced a predetermined distance apart. The area formed by the distance between edge 28 and 30 and the width of he receptacle is normally large enough to hold at least 20 golf balls 26. This area is divided into at least three compartments 34, 36, and 38 so that the golfer may take aim at any one of the compartments to test his putting accuracy. Normally central compartment 36 is narrower than outer compartments 34 and 38 and has a width slightly smaller than a regulation cup. Although such a configuration is not essential, narrower central compartment 36 provides a better test of the putter's accuracy. Compartments 34, 36 and 38 are defined by vertical partitions 40 and 42 extending from the rear edge wall 20 towards front edge 28 of receptable 16. In order to facilitate ball 26 entering the central compartment, the vertical edges of partitions 40, 42 are tapered inwardly towards center compartment 36 so as to direct balls hitting the partitions, 40, 42 inwardly towards the center compartment. In addition, partitions 40, 42 are shorter than side wall 18 to allow balls from the center compartment 36 to go into side compartments 34 and 38.

In order to preclude golf balls 26 from hitting rear edge wall 20 of receptacle 16 and bouncing back onto surface 14 of rigid base 12, a foam rubber cushion 44 is bonded to rear edge wall 20 to absorb impact forces. In addition, top surface 24 taper downwardly from front edge 28 to rear edge 30 to prevent balls 6 from rolling out of receptacle 16 into surface 14 of rigid base 12. In order to prevent rigid base 12 from moving on a floor surface such as a indoor surface having a rug, the hooked portion of a VELCRO type fastener 46 may be bonded to the bottom surface 48 of rigid base 12 adjacent the edge 28 of partitions 16.

It has been found advantageous to utilize any number of four (4) foot long sections of STYROFOAM to form rigid base 12. Each section of rigid base 12 is covered by fabric 14 to form the top putting surface thereof. It is contemplated that two four foot sections would normally be used to provide an eight (8) foot long putting surface. These two sections can be stored in a closet with separate detachable receptables 16 for later assembly and use.

For assembly the two four foot sections of rigid base 12 are both provided with the hooked portion of a VELCRO type fastener 46 at each edge thereof so that bottom surfaces 48 of the two sections of base 12 may be placed on a carpeted floor with inner surfaces (not shown) abutting one another. The placement of VELCRO type fasteners adjacent each inner edge holds the sections of rigid base 12 on the surface, thus effecting a long rigid putting surface. Edges 28 of the receptacle 16 are then placed at either end of the rigid base formed by the two four foot sections with the surfaces 24 thereof flush with the putting surface formed by fabric 14. Of course surface 24 could be stepped below the putting surface of rigid base 12 to prevent balls from rolling into the putting surface. Receptacles 16, normally made from wood or formed from plastic, have sufficient weight to remain located in their proper position adjacent rigid base 12. However, the hooked portions of a VELCRO fastener could also be included on the bottom surface of each receptacle 16 at edge 28 thereof.

Figure 3:
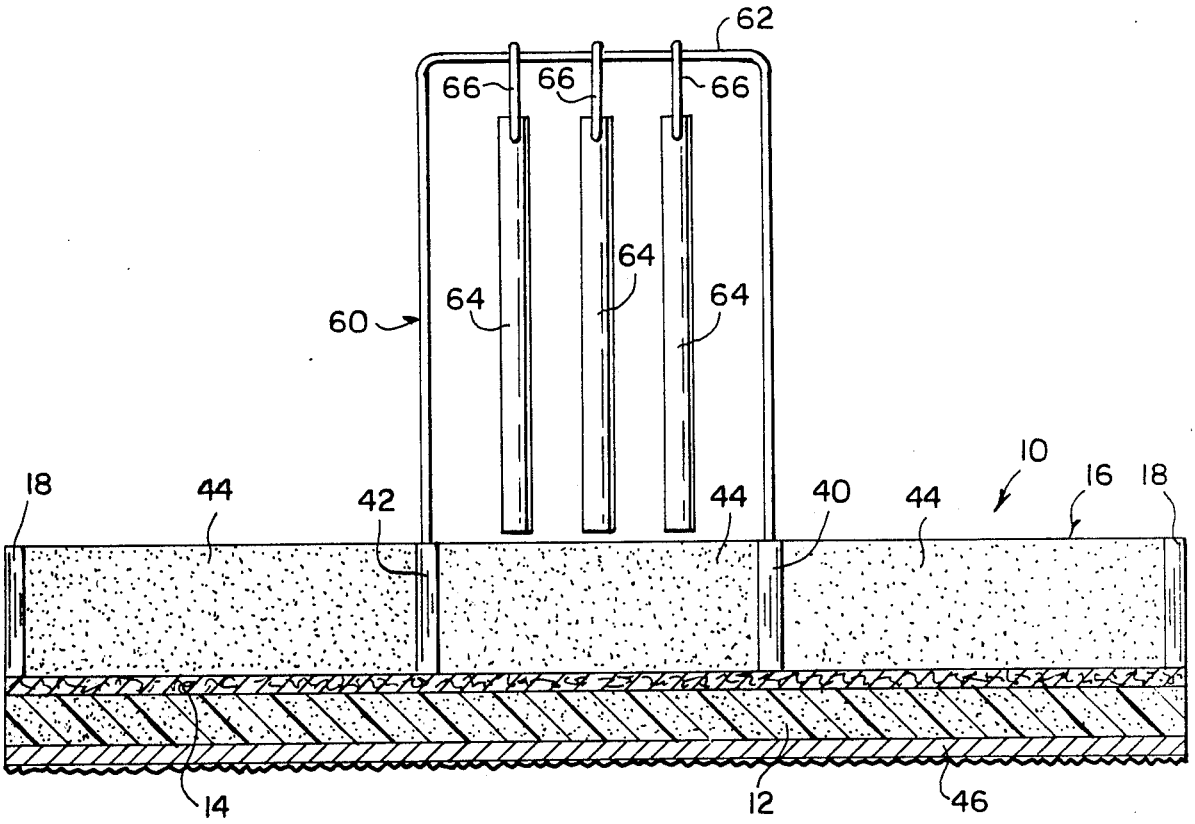
FIG. 3 is an elevation view, partially in cross section, along line 3—3 of FIG. 1.

Referring to FIGS. 1 and 3, there is shown the practice putting game 10 with each receptacle 16 having an optional device for signaling when a golf ball 26 enters center compartment 36 thereof. The preferred signaling device includes a generally U-shaped support 60 which is fixed to and extends upwardly from partitions 40 and 42. Support 60 includes a cross member 62 from which three chimes 64 are suspended by string 66. The bottom ends of chimes 64 are suspended by string 66 just above top surface 24 of each receptacle 16. Strings 66 may be made from nylon, metal or wool. Also, chimes 64 may be directly pivotably coupled to member 62 via holes through the top end of each chime.

When a ball 26 is successfully putted into center compartment 36, the chimes signal the accuracy of the putt. This enables and encourages the golfer to keep his head down during and after he putts the ball. As is well known, keeping one's head down during a golf stroke is important if consistent accuracy is to be achieved. It can be seen that other signaling devices may also be used such as battery powered electric eye coupled to a bell or other signaling device.

To use the putting game of the present invention, it is contemplated that one or two golfers would participate although any number could conceivably partake in the game. After setting up the rigid base as described above, the golfer would place at least twenty golf balls 26 in one receptacle 16 and begin putting along the length of rigid base 12 aiming at one of receptacles 34, 36 or 38. Upon putting the last of the twenty balls, the golfer would then walk to the opposite end of the practice putting game and again putt the balls across the length of rigid base 12 to the opposite receptacle 16. Of course, two golfers can participate wherein each would remain at an opposite end of the putting game and putt the golf balls across the rigid base into the opposite receptacle and wherein the other golfer would then return the balls in like manner.

While two embodiments of the present invention have been illustrated and described, it is obvious that many changes and modifications may be made thereunto, without departing from the spirit and scope of the invention.

What is claimed is:

1. A practice putting game comprising:

a rigid base of predetermined width and length having a top putting surface, a bottom surface for contact with a support surface and first and second ends; and a receptacle contacting each of said first and second ends of the rigid base and having a width generally equal to said predetermined width of said rigid base, each of said receptacles having at least three compartments open toward said respective first and second ends of said rigid base, a said receptacle having a top surface adjacent to said top putting surface of said rigid base.

2. The practice putting game as set forth in claim 1, wherein each of said receptacles is independent of and therefore removable from the first and second ends of said rigid base.

3. The practice putting game as set forth in claim 2, wherein said bottom surface of said rigid base includes means for fastening said rigid base to a carpeted floor.

4. The practice putting game as set forth in claim 3, wherein said means for fastening said rigid base to said carpeted floor is a hooked side of a hook and loop type fastener.

5. The practice putting game as set forth in claim 1, wherein said at least three compartments comprise a narrow center compartment and two wider outer compartments separated by partitions extending upwardly from said surfaces on said partition to said top putting surface.

6. The practice putting game as set forth in claim 5, wherein each compartment has an end open towards said rigid base and each of said upwardly extending partitions has an end being tapered inwardly toward said center section.

7. The practice putting game as set forth in claim 1, wherein said rigid base is composed of a sheet of rigid polystyrene foam of predetermined thickness.

8. The practice putting game as set forth in claim 7, wherein said top putting surface of the rigid base is composed of a fabric putting surface bonded to said polystyrene foam.

9. The practice putting game as set forth in claim 1, wherein each receptable has a front and a rear edge spaced a predetermined distance apart, said front and rear edges are connected by said surface adjacent to said top putting surface of said rigid base, said surface being flush with said top putting surface at said front edge of said receptacle and being downwardly inclined toward said rear edge.

10. The practice putting game as set forth in claim 9, wherein an area defined by said width of said receptable and the predetermined distance between said front and rear edges of each receptacle is sufficient to hold a minimum of twenty golf balls.

11. The practice putting game as set forth in claim 1, wherein a center compartment of said at least three compartments includes means for signaling when a golf ball enters therein.

12. The practice putting game as set forth in claim 11, wherein said means for signaling when a golf ball enters said center compartment includes a plurality of chimes suspended above said top surface of said receptacle.

* * * * *